US009530376B2

(12) United States Patent
Zhang et al.

(10) Patent No.: US 9,530,376 B2
(45) Date of Patent: Dec. 27, 2016

(54) DRIVING DEVICE AND DRIVING METHOD OF LIQUID CRYSTAL DISPLAY DEVICE AND LIQUID CRYSTAL DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Chunbing Zhang, Beijing (CN); Bin Zhang, Beijing (CN); Shuai Hou, Beijing (CN); Yiqiang Lai, Beijing (CN); Liang Zhang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 44 days.

(21) Appl. No.: 14/600,133

(22) Filed: Jan. 20, 2015

(65) Prior Publication Data

US 2016/0203784 A1 Jul. 14, 2016

(30) Foreign Application Priority Data

Jan. 12, 2015 (CN) ..... 2015 1 0015180

(51) Int. Cl.
*G09G 3/36* (2006.01)

(52) U.S. Cl.
CPC .... *G09G 3/3696* (2013.01); *G09G 2320/0247* (2013.01)

(58) Field of Classification Search
CPC ..... G09G 3/36–3/3696; G09G 2320/0247
(Continued)

(56) References Cited

U.S. PATENT DOCUMENTS

2003/0052853 A1* 3/2003 Wu ..... G09G 3/3611 345/90
2005/0001829 A1* 1/2005 Bu ..... G09G 3/3648 345/209

(Continued)

FOREIGN PATENT DOCUMENTS

CN 101995694 A 3/2011
CN 102262867 A 11/2011

OTHER PUBLICATIONS

First Chinese Office Action dated Jul. 5, 2016; Appln. No. 201510015180.5.

*Primary Examiner* — Stephen Sherman
(74) *Attorney, Agent, or Firm* — Ladas & Parry LLP

(57) ABSTRACT

The present disclosure relates to a driving device and a driving method of a liquid crystal display device and a liquid crystal display device. The liquid crystal display device comprises a display panel. The driving method comprising following steps of: displaying a current image by driving the display panel in a current reverse driving mode; detecting a variation value of a common voltage of the display panel during a prescribed period of time, and determining whether the variation value of the common voltage is greater than a prescribed threshold voltage variation; and in case that the variation value of the common voltage is greater than the prescribed threshold voltage variation, determining an occurrence of an image flickering and changing the current reverse driving mode. According to the present disclosure, the flickering of the liquid crystal display device can be reduced.

17 Claims, 4 Drawing Sheets

(58) Field of Classification Search
USPC ..... 345/211, 204, 87–104
See application file for complete search history.

(56) References Cited

U.S. PATENT DOCUMENTS

| | | | | |
|---|---|---|---|---|
| 2010/0265235 | A1 | 10/2010 | Lee | |
| 2011/0037760 | A1 | 2/2011 | Kim et al. | |
| 2011/0292099 | A1 | 12/2011 | Kim et al. | |
| 2016/0043541 | A1* | 2/2016 | Choi ..... | H02H 9/02<br>345/212 |

* cited by examiner

DRIVING DEVICE AND DRIVING METHOD OF LIQUID CRYSTAL DISPLAY DEVICE AND LIQUID CRYSTAL DISPLAY DEVICE

FIELD

The present disclosure relates to a driving device and a driving method of a liquid crystal display device and a liquid crystal display device.

BACKGROUND

As a current mainstream display device, the liquid crystal display dominates the current flat display market due to compact slim design with low power consumption. One of the major issues of the current liquid crystal display device is the flickering of the displayed image, which adversely affected the display quality of the display device.

SUMMARY

The present disclosure provides a driving method of a liquid crystal display device. The liquid crystal display device comprises a display panel. The method comprises following steps of: S610, displaying a current image by driving the display panel in a current reverse driving mode; S620, detecting a variation value of a common voltage of the display panel during a prescribed period of time, and determining whether the variation value of the common voltage is greater than a prescribed threshold voltage variation; and S630, changing the current reverse driving mode in case that the variation value of the common voltage is greater than the prescribed threshold voltage variation and determining an occurrence of an image flickering.

In one example, in case of determining the occurrence of the image flickering, the driving method further comprises storing the current image as a flickering pattern in a flickering pattern storage device of the liquid crystal display device. The flickering pattern comprises color and polarity of each pixel in the current image displayed. After the step of S630, the method further comprises searching for the current image in the flickering pattern storage device, determining whether the current image is a flickering pattern stored in the flickering pattern storage device; and changing the current reverse driving mode in case that the current image is the flickering pattern stored in the flickering pattern storage device.

In one example, the current reverse driving mode comprises a point reverse driving mode, a row reverse driving mode or a column reverse driving mode.

In one example, the step S620 further comprises following steps of: comparing a common voltage value and a prescribed reference voltage value at a start point of the prescribed period of time, and generating a first logic value based on the comparison; comparing a common voltage value and a prescribed reference voltage value at an end point of the prescribed period of time, and generating a second logic value based on the comparison; comparing the first logic value and the second logic value, in case that the first logic value is not equal to the second logic value, determining that the variation value of the common voltage is greater than the prescribed threshold voltage variation; in case that the first logic value is equal to the second logic value, determining that the variation value of the common voltage is not greater than the prescribed threshold voltage variation.

The present disclosure further provides a liquid crystal display device, comprising a display panel configured for displaying a current image in a current reverse driving mode. The display panel comprises: a common voltage detecting device configured for detecting a variation value of a common voltage of the display panel during a prescribed period of time, and determining whether the variation value of the common voltage is greater than a prescribed threshold voltage variation; and a driving mode control device configured for receiving the determination result from the common voltage detecting device, and in case that the variation value of the common voltage is greater than the prescribed threshold voltage variation, determining an occurrence of an image flickering and changing the current reverse driving mode.

In one example, the display panel further comprises a flickering pattern storage device configured for storing the current image as a flickering pattern in case of determining the occurrence of the image flickering. The driving mode control device is further configured for searching for the current image in the flickering pattern storage device and changing the current reverse driving mode in case that the current image is the flickering pattern stored in the flickering pattern storage device.

In one example, the common voltage detecting device comprises a voltage comparing device comprising a first input terminal, a second terminal, and an output terminal and configured for comparing a common voltage value and a prescribed reference voltage value at a start point of the prescribed period of time and generating a first logic value based on the comparison; comparing a common voltage value and a prescribed reference voltage value at an end point of the prescribed period of time and generating a second logic value based on the comparison. The driving mode control device is configured so that in case that the first logic value is not equal to the second logic value, determining that the variation value of the common voltage is greater than the prescribed threshold voltage variation; and in case that the first logic value is equal to the second logic value, and determining that the variation value of the common voltage is not greater than the prescribed threshold voltage variation.

In one example, the voltage comparing device is disposed in a TCON controller of the display panel.

In one example, the voltage comparing device further comprises a common voltage sampling circuit configured for relaying the common voltage of the display panel to a first input terminal of the voltage comparing device.

The present disclosure further provides a driving device of a display panel. The display panel is configured for displaying a current image in a current reverse driving mode. The driving device comprises: a common voltage detecting device configured for detecting a variation value of a common voltage of the display panel during a prescribed period of time, and determining whether the variation value of the common voltage is greater than a prescribed threshold voltage variation; and a driving mode control device configured for receiving the determination result from the common voltage detecting device, and in case that the variation value of the common voltage is greater than the prescribed threshold voltage variation, determining an occurrence of an image flickering and changing the current reverse driving mode.

In one example, the driving device further comprises a flickering pattern storage device configured for storing the current image as a flickering pattern in case of determining the occurrence of the image flickering, the flickering pattern comprises color and polarity of each pixel in the current image displayed.

According to the present disclosure, the degree of variation of the common voltage is used as a measure of the image flickering, and a different reverse driving mode is used if the image flickering occurs, thus avoiding that the pixels displaying color especially the same color in the current image have the same polarity, thereby reducing or eliminating the image flickering.

BRIEF DESCRIPTION OF THE DRAWINGS

In order to clearly illustrate the technical solution of the present disclosure, the technical solution of the present disclosure will be further described with reference to the following drawings. The drawings described in the following are only related to a part of embodiments of the technical solution of the present disclosure.

DETAILED DESCRIPTION OF THE PREFERRED EMBODIMENTS

The technical solution of the embodiments of the present disclosure will be described clearly and fully in connection with the drawings of the embodiments of the present disclosure. It is obvious that the described embodiments are just a part but not all of the embodiments of the present disclosure. Based on the described embodiments of the present disclosure, those skilled in the art can obtain all other embodiment without any inventive work, which all fall into the scope of the claimed invention.

Unless otherwise defined, technical terms or scientific terms used herein shall have a common meaning known by those skilled in the art of the present disclosure. Words and expressions such as "first", "second" and the like used in the description and claims of the patent application of the present disclosure do not denote any sequence, quantity or importance, but distinguish different components. Likewise, words such as "a", "an" and the like do not denote quantitative restrictions, but denote the presence of at least one. Words such as "connected", "connecting" and the like are not restricted to physical or mechanical connections, but may include electrical connections, regardless of direct or indirect connections. Words such as "up", "below", "left", "right", etc., are only used to denote the relative positional relationship. Upon the absolute position of the described object changes, the relative positional relationship change correspondingly.

Figure 1:
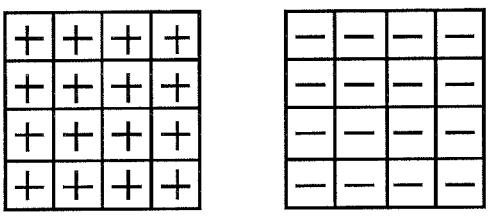
FIGS. 1-4 are schematic views showing reverse driving modes of a liquid crystal display device.
Figure 2:
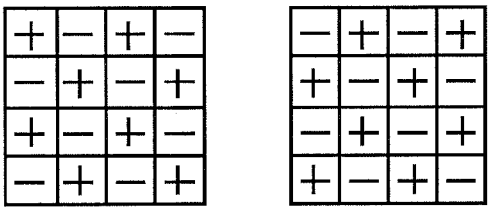
Figure 3:
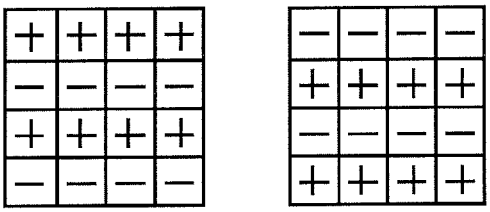
Figure 4:
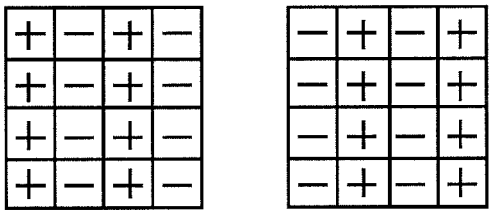

In a driving method of the liquid crystal display device, it is necessary to apply an electrical field with a changed polarity so as to reduce the fatigue of the liquid crystal, thereby achieving a good display quality. This is referred as a reverse driving mode of a liquid crystal display device. The reverse driving mode includes a frame reverse driving mode, a point reverse driving mode, a row reverse driving mode or a column reverse driving mode. FIGS. 1-4 are schematic views showing the frame reverse driving mode, the point reverse driving mode, the row reverse driving mode or the column reverse driving mode of a liquid crystal display device, respectively. Each pixel is represented by a block and the signs "+" and "−" in the blocks refer to two opposing polarities of the liquid crystals in the respective pixels. As shown in FIG. 1, in the frame reverse driving mode, all pixels in a frame of image have the same polarity. As shown in FIG. 2, in the point reverse driving mode, each pixel has a different polarity than the polarity of an adjacent pixel. As shown in FIG. 3, in the row reverse driving mode, pixels in a row in a frame of image have the same polarity, but have a different polarity than the polarity in the pixels in the adjacent row. As shown in FIG. 4, in the column reverse driving mode, pixels in a column in a frame of image have the same polarity, but have a different polarity than the polarity in the pixels in the adjacent column. In the display of the next frame of image, the polarities of all pixels will be reversed.

Figure 5:
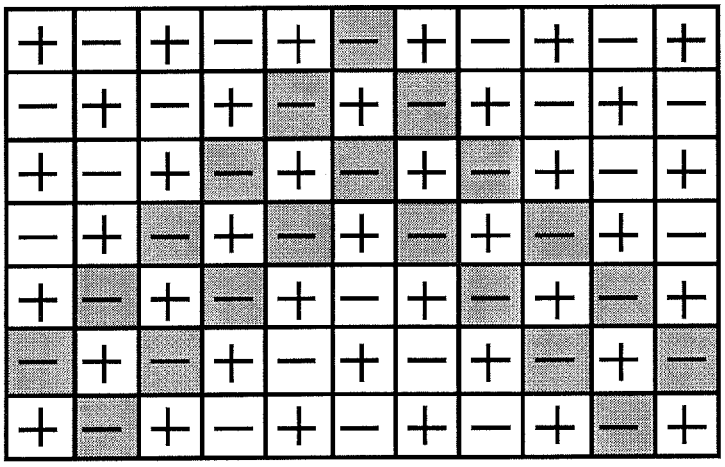
FIG. 5 is a schematic view of a display panel of a liquid crystal display device displaying a pattern with a flickering phenomenon.

When the pixels of the pattern displayed in a frame of image have the same polarity, the liquid crystal display device has the most severe flickering, compared with the same pattern displayed with different polarities. For example, as shown in FIG. 5, the pixels of the pattern displayed in a frame of image marked with a grey color have the same negative polarity. In this case, the pattern displayed on the liquid crystal display device will have the most severe flickering. In addition, since the human eyes are more susceptible to the brightness variation of a green pixel, in case of the pixels of the displayed pattern have a green color, the flickering observed by the human eyes will be more severe. That is, in case of majority of pixels in the displayed pattern have a same color for example a green color and a same polarity, the flickering of the displayed pattern in the liquid crystal display device sensed by the human eyes will be more severe. Therefore, the present inventor proposes changing the polarities of the pixels by changing the reverse driving mode of the display panel of the liquid crystal display device, thus avoiding majority of the pixels displaying the pattern have the same polarity. In this case, the flickering of the liquid crystal display device is reduced or eliminated.

The present inventors further discover that the image with severe flickering introduces a significant variation in the common voltage. Therefore, it can be determined whether there is flickering in the current image displayed in the liquid crystal display device by detecting the variation of the common voltage.

Figure 6:
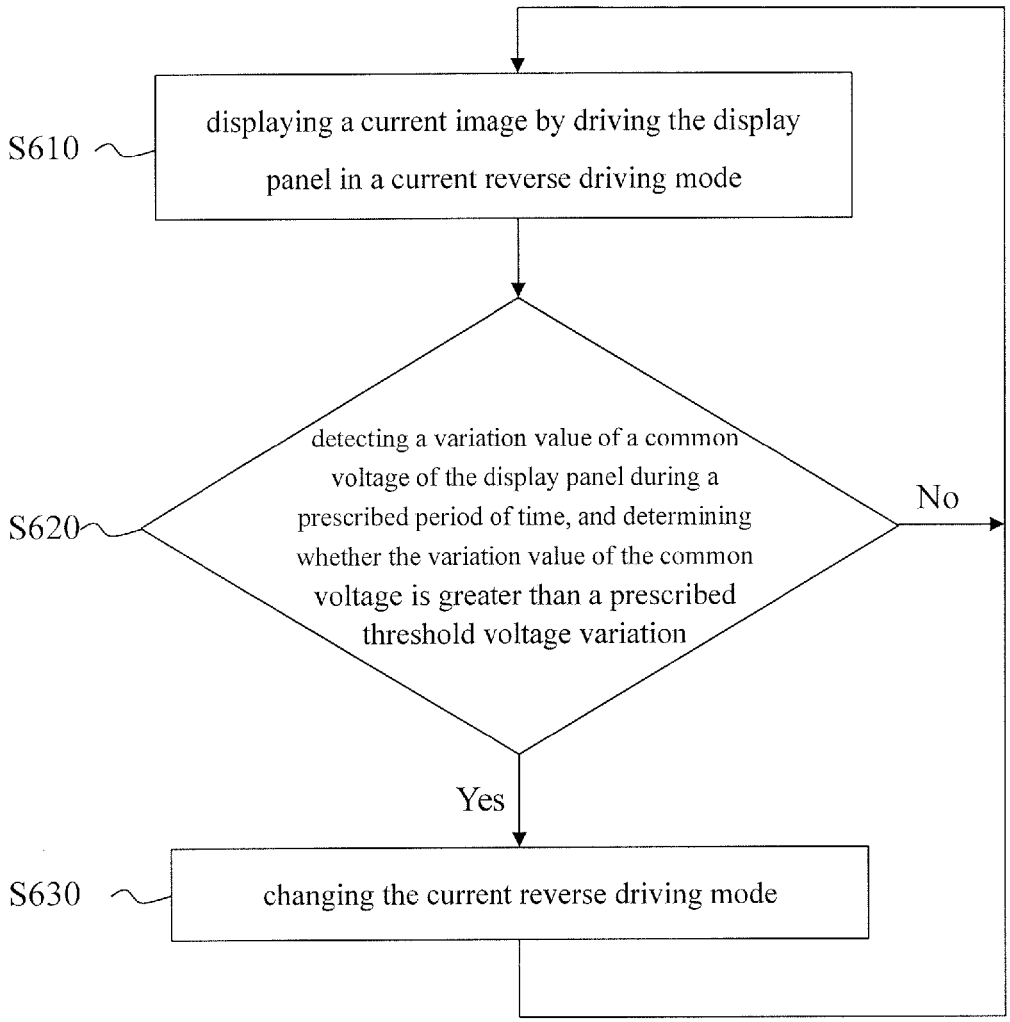
FIG. 6 is a flowchart of a driving method of a liquid crystal display device according to a first embodiment of the present disclosure.

To this end, the present disclosure provides a driving method of a liquid crystal display device. The liquid crystal display device includes a display panel. FIG. 6 is a flowchart of a driving method of a liquid crystal display device according to a first embodiment of the present disclosure. As shown in FIG. 6, the driving method includes following steps: S610, displaying a current image by driving the display panel in a current reverse driving mode; S620, detecting a variation value of a common voltage of the display panel during a prescribed period of time, and determining whether the variation value of the common voltage is greater than a prescribed threshold voltage variation; and S630, changing the current reverse driving mode in case that the variation value of the common voltage is greater than the prescribed threshold voltage variation and determining an occurrence of an image flickering and returning to step S610, that is displaying a current image by driving the display panel in a changed current reverse driving mode; or returning to step S610 directly of displaying the current image by driving the display panel in the current reverse driving mode continuously in case that the variation value of the common voltage is not greater than the prescribed threshold voltage variation and determining no occurrence of an image flickering.

Figure 8:
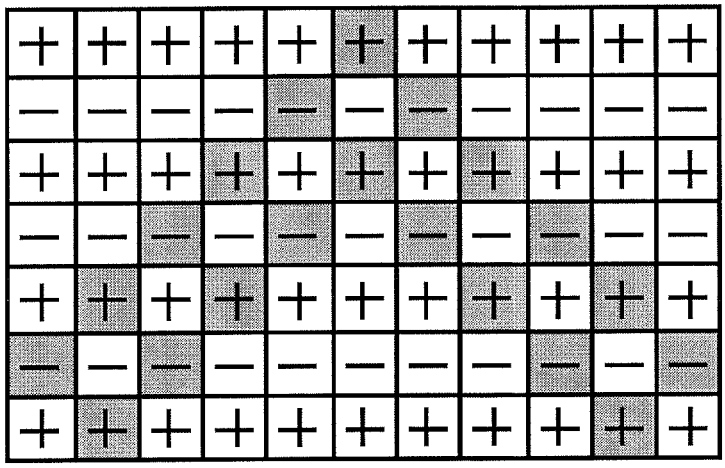
FIG. 8 is a schematic view showing changing a pattern with flickering phenomenon as shown in FIG. 5 as a pattern without flickering according to the driving method of the present disclosure.

In the above method, in case that majority of pixels displaying the pattern in the current frame of image have the same polarity so that the image has a flickering phenomenon, a different reverse driving mode can be used for displaying the pattern in the next frame of the image so as to change the polarity distribution of the pattern, thereby reducing or avoiding the occurrence of the flickering. For example, as shown in FIG. 5, the pixels represented by grey color for displaying a pattern in a frame of image have the same negative polarity in the point reverse driving mode, therefore the flickering occurs in such pattern. According to the method of the present disclosure, a different reverse driving mode for example a row reverse driving mode is used in the step S630, as shown in FIG. 8, so that the pixels for displaying the pattern in the next frame of image have both positive and negative polarity and substantial uniform distribution, thereby reducing or avoiding the occurrence of the flickering.

In the embodiments of the present disclosure, the reverse driving mode includes a point reverse driving mode, a row reverse driving mode or a column reverse driving mode.

In one example, the step S620 can include: comparing a common voltage value and a prescribed reference voltage value at a start point of the prescribed period of time, and generating a first logic value based on the comparison; comparing a common voltage value and a prescribed reference voltage value at an end point of the prescribed period of time, and generating a second logic value based on the comparison; comparing the first logic value and the second logic value, in case that the first logic value is not equal to the second logic value, determining that the variation value of the common voltage is greater than the prescribed threshold voltage variation; in case that the first logic value is equal to the second logic value, determining that the variation value of the common voltage is not greater than the prescribed threshold voltage variation.

In particular, the prescribed reference voltage can be a lower threshold of the common voltage. In case that the common voltage detected at the start point of the prescribed period of time is greater than the lower threshold, the first logic value can be set as "1". In case that the common voltage detected at the end point of the prescribed period of time is still greater than the lower threshold, the second logic value can also be set as "1". In this case, the first logic value is equal to the second logic value, thereby determining that the variation of common voltage does not introduce a flickering. On the contrary, in case that the common voltage detected at the start point of the prescribed period of time is greater that the lower threshold, the first logic value can be set as "1", whereas the common voltage detected at the end point of the prescribed period of time is less than the lower threshold, the second logic value can also be set as "0". In this case, the first logic value is not equal to the second logic value, thereby determining that the variation of common voltage exceeds the prescribed threshold voltage variation and introduces a flickering. In another example, the prescribed reference voltage can be an upper threshold of the common voltage. In case that the common voltage detected at the start point of the prescribed period of time is less than the upper threshold, the first logic value can be set as "1". In case that the common voltage detected at the end point of the prescribed period of time is still less than the upper threshold, the second logic value can also be set as "1". In this case, the first logic value is equal to the second logic value, thereby determining that the variation of common voltage does not introduce a flickering. On the contrary, in case that the common voltage detected at the start point of the prescribed period of time is less than the upper threshold, the first logic value can be set as "1", whereas the common voltage detected at the end point of the prescribed period of time is greater than the upper threshold, the second logic value can also be set as "0". In this case, the first logic value is not equal to the second logic value, thereby determining that the variation of common voltage exceeds the prescribed threshold voltage variation and introduces a flickering.

In addition, the prescribed period of time can be set for example shorter than the period of time for displaying one frame of image in the display panel of the liquid crystal display device, thereby the occurrence of flickering can determined during the display of that frame of image.

Figure 7:
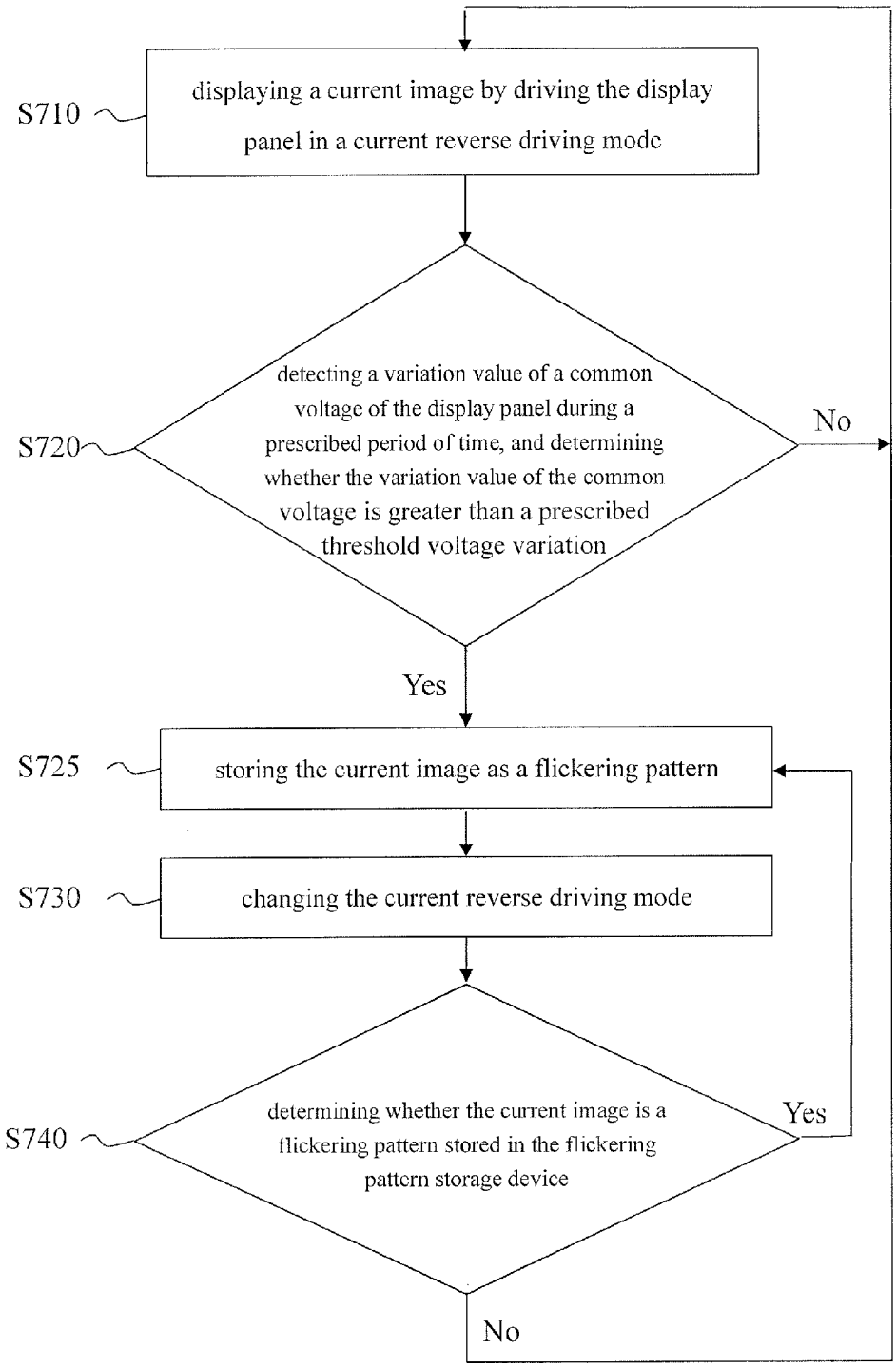
FIG. 7 is a flowchart of a driving method of a liquid crystal display device according to a second embodiment of the present disclosure.

FIG. 7 is a flowchart of a driving method of a liquid crystal display device according to a second embodiment of the present disclosure. The driving method of a liquid crystal display device according to a second embodiment of the present disclosure includes the steps of S710, S720 and S730, which are substantially the same as the steps of S610, S620 and S630 in the first embodiment and will not be described repeatedly. Furthermore, the driving method according to a second embodiment of the present disclosure further comprises a step of S725, storing the current image as a flickering pattern in a flickering pattern storage device of the liquid crystal display device in case of determining occurrence of the flickering. The flickering pattern includes color and polarity of each pixel in the current image displayed. The skilled in the art can understand that steps of S725 and S730 can be performed sequentially or simultaneously, or step S730 can be performed before step S725. Correspondingly, after the step of S730, that is, after changing the current reverse driving mode, the driving method can further include a step of searching for the current image driven by the changed reverse driving mode in the flickering pattern storage device. In case that the current image is the flickering pattern stored in the flickering pattern storage device, then the current reverse driving mode is changed directly without detecting the variation of the common voltage during a prescribed period of time, thereby avoiding the flickering phenomenon.

Figure 9:
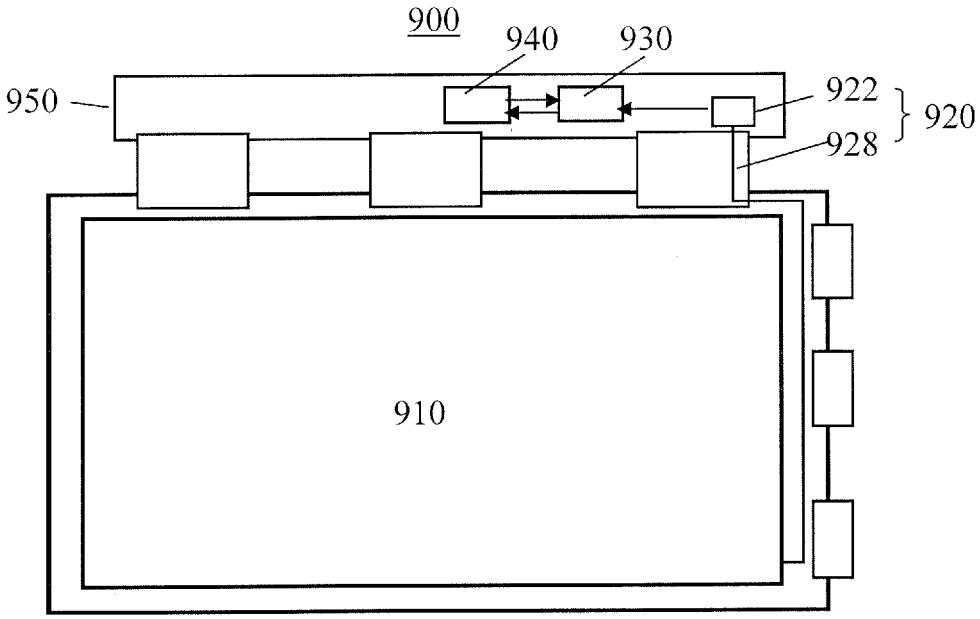
FIG. 9 is a schematic view of a liquid crystal display device according to an embodiment of the present disclosure.

The embodiment of the present disclosure further provides a liquid crystal display device. FIG. 9 is a schematic view of a liquid crystal display device according to an embodiment of the present disclosure. As shown in FIG. 9, the liquid crystal display device comprises: a display panel 900 configured for displaying a current image in an effective image display region 910 with a current reverse driving mode. The display panel 900 comprises: a common voltage detecting device 920 configured for detecting a variation value of a common voltage of the display panel during a prescribed period of time, and determining whether the variation value of the common voltage is greater than a prescribed threshold voltage variation; and a driving mode control device 930 configured for receiving the determination result from the common voltage detecting device, and in case that the variation value of the common voltage is greater than the prescribed threshold voltage variation, determining an occurrence of an image flickering and changing the current reverse driving mode. The driving mode control device 930 can be implemented in circuits or ICs.

In one example, the display panel can further include a flickering pattern storage device 940 configured for storing the current image as a flickering pattern in case of determining the occurrence of the image flickering. The flickering pattern storage device 940 can be any storage device such as flash memory, and the flickering pattern can be stored in a database in the storage device. In such case, the driving mode control device 930 is further configured for searching for the current image in the flickering pattern storage device 940 and changing the current reverse driving mode in case that the current image is the flickering pattern stored in the flickering pattern storage device. The flickering pattern includes color and polarity of each pixel in the current image displayed.

Figure 10:
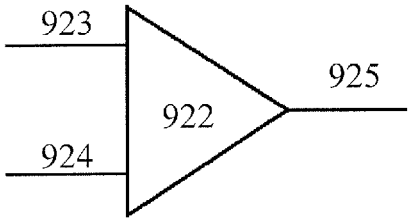
FIG. 10 is a schematic view of a voltage comparing device of a liquid crystal display device according to an embodiment of the present disclosure.

In one example, the common voltage detecting device 920 includes a voltage comparing device 922 and an optional common voltage sampling circuit 928. FIG. 10 is a schematic view of an example of voltage comparing device 922. The voltage comparing device 922 includes a first input terminal 923, a second terminal 924, and an output terminal 925. The voltage comparing device 922 is configured for comparing a common voltage value at the first input terminal 923 and a prescribed reference voltage value at the second input terminal 924 at a start point of the prescribed period of time and generating a first logic value at the output terminal 925 based on the comparison; comparing a common voltage value at the first input terminal 923 and a prescribed reference voltage value at the second input terminal 924 at an end point of the prescribed period of time and generating a second logic value based on the comparison at the output terminal 925. The first logic value and the second logic value can be a high level representing "1" and a low level representing "0".

For example, the prescribed reference voltage can be a lower threshold of the common voltage. In case that the common voltage detected at the first input terminal 923 at the start point of the prescribed period of time is greater than the lower threshold at the second input terminal 924, the first logic value can be set as "1". In case that the common voltage detected at the first input terminal 923 at the end point of the prescribed period of time is still greater than the lower threshold at the second input terminal 924, the second logic value can also be set as "1". On the contrary, in case that the common voltage detected at the first input terminal 923 at the start point of the prescribed period of time is greater that the lower threshold at the second input terminal 924, the first logic value can be set as "1", whereas the common voltage detected at the first input terminal 923 at the end point of the prescribed period of time is less than the lower threshold at the second input terminal 924, the second logic value can also be set as "0".

In this case, if the first logic value is equal to the second logic value, the common voltage detecting device 930 determines that the variation of common voltage does not introduce the flickering. On the contrary, if the first logic value is not equal to the second logic value, the common voltage detecting device 930 determines that the variation of common voltage exceeds the prescribed threshold voltage variation and introduces a flickering.

As shown in FIG. 9, the common voltage sampling circuit 928 relays the common voltage of the display panel to a first input terminal 923 of the voltage comparing device 922.

As shown in FIG. 9, the voltage comparing device 924 is disposed in a TCON controller 950 of the display panel. In addition, the driving mode control device 930 and flickering pattern storage device 940 can also be disposed in the TCON 950 of the display panel 900.

The present disclosure further provides a driving device of a display panel. The display panel is configured for displaying a current image in a current reverse driving mode. The driving device comprises: a common voltage detecting device 920 configured for detecting a variation value of a common voltage of the display panel during a prescribed period of time, and determining whether the variation value of the common voltage is greater than a prescribed threshold voltage variation; and a driving mode control device 930 configured for receiving the determination result from the common voltage detecting device, and in case that the variation value of the common voltage is greater than the prescribed threshold voltage variation, determining an occurrence of an image flickering and changing the current reverse driving mode.

According to the present disclosure, the degree of variation of the common voltage is used as a measure of the image flickering, and a different reverse driving mode is used if the image flickering occurs, thus avoiding that the pixels displaying color especially the same color in the current image have the same polarity, thereby reducing or eliminating the image flickering.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable the skilled in the art to best utilize the invention in various embodiments and with various modifications as are suited to the particular use contemplated. It is intended that the scope of the invention be defined by the claims appended hereto.

What is claimed is:

1. A driving method of a liquid crystal display device, the liquid crystal display device comprising a display panel, the method comprising following steps of:

S610, displaying a current image by driving the display panel in a current reverse driving mode;

S620, detecting a variation value of a common voltage of the display panel during a prescribed period of time, and determining whether the variation value of the common voltage is greater than a prescribed threshold voltage variation; and S630, changing the current reverse driving mode in case that the variation value of the common voltage is greater than the prescribed threshold voltage variation and determining an occurrence of an image flickering, wherein the step S620 further comprises following steps of:

comparing a common voltage value and a prescribed reference voltage value at a start point of the prescribed period of time, and generating a first logic value based on the comparison; comparing a common voltage value and a prescribed reference voltage value at an end point of the prescribed period of time, and generating a second logic value based on the comparison;

comparing the first logic value and the second logic value, in case that the first logic value is not equal to the second logic value, determining that the variation value of the common voltage is greater than the prescribed threshold voltage variation; in case that the first logic value is equal to the second logic value, determining that the variation value of the common voltage is not greater than the prescribed threshold voltage variation.

2. The driving method according to claim 1, wherein in case of determining the occurrence of the image flickering, the driving method further comprises storing the current image as a flickering pattern in a flickering pattern storage device of the liquid crystal display device.

3. The driving method according to claim 2, wherein the flickering pattern comprises color and polarity of each pixel in the current image displayed.

4. The driving method according to claim 3, after the step of S630, further comprising searching for the current image in the flickering pattern storage device, determining whether the changed current image is one of flickering patterns stored in the flickering pattern storage device; and changing the current reverse driving mode in case that the changed current image is the flickering pattern stored in one of the flickering patterns storage device.

5. The driving method according to claim 1, wherein the current reverse driving mode comprises a point reverse driving mode, a row reverse driving mode or a column reverse driving mode.

6. A liquid crystal display device, comprising:

a display panel configured for displaying a current image in a current reverse driving mode;

the display panel comprising:

a common voltage detecting device configured for detecting a variation value of a common voltage of the display panel during a prescribed period of time, and determining whether the variation value of the common voltage is greater than a prescribed threshold voltage variation; and a driving mode control device configured for receiving the determination result from the common voltage detecting device, and in case that the variation value of the common voltage is greater than the prescribed threshold voltage variation, determining an occurrence of an image flickering and changing the current reverse driving mode, wherein the common voltage detecting device comprises:

a voltage comparing device comprising a first input terminal, a second terminal, and an output terminal and configured for comparing a common voltage value and a prescribed reference voltage value at a start point of the prescribed period of time and generating a first logic value based on the comparison; comparing a common voltage value and a prescribed reference voltage value at an end point of the prescribed period of time and generating a second logic value based on the comparison;

the driving mode control device configured such that in case that the first logic value is not equal to the second logic value, determining that the variation value of the common voltage is greater than the prescribed threshold voltage variation; and in case that the first logic value is equal to the second logic value, and determining that the variation value of the common voltage is not greater than the prescribed threshold voltage variation.

7. The liquid crystal display device according to claim 6, wherein the display panel further comprises a flickering pattern storage device configured for storing the current image as a flickering pattern in case of determining the occurrence of the image flickering.

8. The liquid crystal display device according to claim 7, wherein the flickering pattern comprises color and polarity of each pixel in the current image displayed.

9. The liquid crystal display device according to claim 8, wherein the driving mode control device is further configured for, after changing the current reverse driving mode, searching for the changed current image in the flickering pattern storage device and changing the current reverse driving mode in case that the changed current image is the flickering pattern stored in one of flickering patterns storage device.

10. The liquid crystal display device according to claim 6, wherein the current reverse driving mode comprises a point reverse driving mode, a row reverse driving mode or a column reverse driving mode.

11. The liquid crystal display device according to claim 6, wherein the voltage comparing device is disposed in a TCON controller of the display panel.

12. The liquid crystal display device according to claim 11, wherein the voltage comparing device further comprises a common voltage sampling circuit configured for relaying the common voltage of the display panel to a first input terminal of the voltage comparing device.

13. A driving device of a display panel, the display panel configured for displaying a current image in a current reverse driving mode, the driving device comprising:

a common voltage detecting device configured for detecting a variation value of a common voltage of the display panel during a prescribed period of time, and determining whether the variation value of the common voltage is greater than a prescribed threshold voltage variation; and a driving mode control device configured for receiving the determination result from the common voltage detecting device, and in case that the variation value of the common voltage is greater than the prescribed threshold voltage variation, determining an occurrence of an image flickering and changing the current reverse driving mode, wherein the common voltage detecting device comprises:

a voltage comparing device comprising a first input terminal, a second terminal, and an output terminal and configured for comparing a common voltage value and a prescribed reference voltage value at a start point of the prescribed period of time and generating a first logic value based on the comparison; comparing a common voltage value and a prescribed reference voltage value at an end point of the prescribed period of time and generating a second logic value based on the comparison;

the driving mode control device configured such that in case that the first logic value is not equal to the second logic value, determining that the variation value of the common voltage is greater than the prescribed threshold voltage variation; and in case that the first logic value is equal to the second logic value, and determining that the variation value of the common voltage is not greater than the prescribed threshold voltage variation.

14. The driving device according to claim 13, further comprising a flickering pattern storage device configured for storing the current image as a flickering pattern in case of determining the occurrence of the image flickering, the flickering pattern comprises color and polarity of each pixel in the current image displayed.

15. The driving device according to claim 14, wherein the driving mode control device is further configured for, after changing the current reverse driving mode, searching for the changed current image in the flickering pattern storage device and changing the current reverse driving mode in case that the changed current image displayed in the current reverse driving mode is one of flickering patterns stored in the flickering pattern storage device.

16. The driving device according to claim 15, wherein the current reverse driving mode comprises a point reverse driving mode, a row reverse driving mode or a column reverse driving mode.

17. The driving device according to claim 13, wherein the voltage comparing device is disposed in a TCON controller of the display panel, and the voltage comparing device further comprises a common voltage sampling circuit configured for relaying the common voltage of the display panel to a first input terminal of the voltage comparing device.

* * * * *